US006329932B1

(12) United States Patent
Fastenrath

(10) Patent No.: US 6,329,932 B1
(45) Date of Patent: Dec. 11, 2001

(54) METHOD FOR DETERMINING TRAFFIC DATA AND TRAFFIC INFORMATION EXCHANGE

(75) Inventor: Ülrich Fastenrath, Düsseldorf (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/367,551

(22) PCT Filed: Feb. 10, 1998

(86) PCT No.: PCT/DE98/00441

§ 371 Date: Aug. 16, 1999

§ 102(e) Date: Aug. 16, 1999

(87) PCT Pub. No.: WO98/36397

PCT Pub. Date: Aug. 20, 1998

(30) Foreign Application Priority Data

Feb. 14, 1997 (DE) ..... 197 07 344
Aug. 21, 1997 (DE) ..... 197 37 440

(51) Int. Cl.[7] ..... G08G 1/065
(52) U.S. Cl. ..... 340/934; 340/936; 701/119
(58) Field of Search ..... 340/934, 936, 340/905, 988; 701/117, 118, 119

(56) References Cited

U.S. PATENT DOCUMENTS 5,289,183 * 2/1994 Hassett et al. ..... 340/905
5,539,645 * 7/1996 Mandhyan et al. ..... 364/438
5,699,056 * 12/1997 Yoshida ..... 340/905
6,092,020 * 7/2000 Fastenrath et al. ..... 701/119
6,131,064 * 10/2000 Vieweg ..... 701/117

* cited by examiner

*Primary Examiner*—Daniel J. Wu
*Assistant Examiner*—Sihong Huang
(74) *Attorney, Agent, or Firm*—Cohen, Pontani, Lieberman & Pavane

(57) ABSTRACT

A method for determining traffic data at points of interest in a traffic system from:

vehicle data which are transmitted to a center from a plurality of vehicles relating to mean speeds (which have been determined over a time interval) of in each case one vehicle;

stationary detector data which are transmitted to the center by stationary detectors in each case relating to the mean speed of vehicles passing a stationary detector in a time interval, wherein vehicle speeds at a point of interest are determined in the center, with the speeds which have been transmitted as vehicle data to the center being associated with defined points in the traffic system, and with vehicle speeds being calculated at in each case one point of interest by interpolation of at least two vehicle data items, namely by interpolation of stationary detector data measured in each case at at least one point in the traffic system and/or of vehicle data associated with at least one point in the traffic system.

12 Claims, 3 Drawing Sheets

METHOD FOR DETERMINING TRAFFIC DATA AND TRAFFIC INFORMATION EXCHANGE

BACKGROUND OF THE INVENTION

1. Field of the Invention

The invention relates to a method for determining traffic data, and to a traffic information center.

2. Discussion of the Prior Art

Methods exist for automatically producing traffic reports by assessing point-related data from stationary vehicle detectors, such as induction loops, in order to assess the traffic situation at or in the vicinity of the stationary detectors. In this case, data detected by a plurality of stationary detectors along, for example, a road section are collated in a center to form messages such as "three kilometer traffic jam between $X_{18}$ and $X_2$".

With regard to optimization of this system by determining traffic data on the basis of measurements from stationary detectors and mobile detectors (that is to say detectors which are also moving in the traffic), it is problematic that data from the two types,of detector are transmitted only at relatively long time intervals as a result of the telecommunications costs incurred for transmission to a center and that, owing to the limited number of stationary and mobile detectors, the data are transmitted only at relatively long distance intervals. Furthermore, and in particular, the data supplied from these two data sources and relating to vehicle speeds differ since, for example, the mean speed of travel of this one vehicle in this time interval along a path travelled by this vehicle is transmitted by vehicles to a center after a time interval in each case, while the mean vehicle speed of a large number of vehicles passing a specific point in the traffic system, namely the location of the detector, is transmitted by a stationary detector to the center within a time interval which is, furthermore, often relatively short. Separate treatment of single-point-related data (originating from stationary detectors) and distance-related data (originating from mobile detectors) results in inaccurate and inconsistent reports relating to the traffic situation.

Existing approaches to determining traffic data, in particular traffic jam reports, on the basis of speed measurements from stationary detectors and from mobile detectors, namely traffic flow models, domain models, microscopic models, are highly complex and have not been tested much in practice; in addition, some of these existing methods require a certain amount of input data synchronism.

SUMMARY OF THE INVENTION

The object of the invention is therefore to provide a method which is as simple and efficient as possible for determining traffic data at points of interest in a traffic system, taking account not only of vehicle data which respectively relate to the mean speed of one vehicle but also of stationary detector data which relate to the mean speed of a number of vehicles at one stationary detector.

Traffic data to be determined in the sense of the invention may, in particular, be mean vehicle speeds at points of interest in a traffic system and/or traffic jam indicators (free, slow moving, very slow moving, traffic jam) determined from these speeds and, possibly, from other additional information. Points of interest in a traffic system may, in particular, be points where vehicle drivers wish to have data relating to the traffic situation there, in particular traffic jam indicators; furthermore, points of interest may be junctions, ramps, intersections and/or ends of road segments of a road on a digital map. If no up-to-date FCD data are available at a point, interpolation can be carried out from data from at least two stationary detectors. If only FCD data are available at a point, FCD data can be interpolated from at least two vehicles. At at least some points, the interpolation is carried out on the basis of data from at least one vehicle and data from at least one stationary detector, possibly from a plurality in each case. In addition, it is possible to determine traffic data, in particular the traffic jam situation, at a large number of points defined, for example, in a close grid, and to transmit to vehicle drivers only significant traffic data such as traffic jams which are building up, are in existence or are clearing. The calculation of vehicle speeds, in particular of mean vehicle speeds, at each point of interest is expediently carried out by means of a program running in a computer in a traffic information center.

When calculating mean vehicle speeds at points of interest, the vehicle detector data and/or stationary detector data may be weighted. The weighting can be carried out from values based on experience. The quality of the results of the method can thus be optimized.

According to one refinement of the invention, the speed at the current point in time at each one point of interest is determined by linear interpolation of two speed values, which are adjacent in terms of position and/or time, from stationary detector data and/or from vehicle data. Interpolation from more than two speed values is also possible. Linear interpolation of speeds $v(x, t)$ is the simplest form of interpolation to carry out by computer and results in relatively low errors. In contrast, higher-order interpolation processes take more computation time and provide only slightly better results.

With regard to the interpolation of speeds $v(x, t)$, it is expedient also to take account of additional information, in particular information relating to roadworks and/or the proportion of trucks on road segments and/or traffic flows in specific traffic lanes, which likewise optimizes the quality of the results of the method according to the invention.

The association of vehicle data (that is to say data transmitted from one vehicle in each case, that is to say FCD) with defined points is preferably carried out by definition of the speed (which in each case represents one vehicle in vehicle data) as the speed of that vehicle at a defined point such as, in particular, at a position in the road segment at which the vehicle is currently located. This position may be, in particular, the start, middle or end or the like of the current road segment on a digital map of the traffic system in a computer in the center. This reduces the accuracy only to a relatively minor extent. However, it allows simple and efficient conversion of distance-related FCD data to singlepoint-related data, and thus joint analysis of vehicle data (FCD) and stationary detector data.

On the basis of the measured traffic data and the traffic data determined according to the invention, in particular speeds at a large number of points of interest with measurement data or interpolated data for a traffic system, a traffic jam indicator (free, slow moving, very slow moving, traffic jam etc.) is expediently assigned to these points in the traffic system on the basis of the vehicle speeds measured or calculated for these points of interest. This traffic jam indicator is even more suitable for assessing the traffic jam situation and for transmission to those in the traffic as mean speeds at a large number of points.

Furthermore, traffic information ("traffic jam between A and B on the A8" or the like), in particular in traffic jam reports, relating to traffic system segments is expediently determined and issued on the basis of a number of traffic jam indicators (such as 1. "traffic jam at A on the A8" and 2. "traffic jam at B on the A8" and, possibly, other local traffic jam indicators at other points of interest) which are, in particular, associated in terms of position with these traffic system segments. The traffic information which can be transmitted to those in the traffic is thus compressed. Only traffic information (such as traffic jams) which is assessed as being important on the basis of criteria which can be predetermined is preferably in this case issued by the program in the center.

The time interval within which a vehicle determines its own mean speed is expediently longer than the time interval within which the speeds of vehicles passing a stationary detector are in each case measured and averaged by this stationary detector. This results in further practical optimization of the method with regard to precision and the telecommunications costs involved. The intervals in which vehicles determine and transmit their mean speed are expediently 1 to 20 minutes, in particular 10 minutes. The time interval within which a stationary detector in each case determines the mean speeds of vehicles passing it and transmits them to a center is expediently 5 to 300 seconds, in particular 30 seconds.

A traffic information center according to the invention has a computer, an input device, in particular in the form of a radio receiver, for vehicle data and stationary detector data, as well as a computer with a program for carrying out the method according to the invention. This center uses the program for carrying out the method according to the invention to produce traffic data in a simple, economic and efficient manner, in particular mean speeds and/or traffic jam indicators (which can be determined from them) relating to points of interest in a traffic system, on the basis of vehicle data and stationary detector data. Further features and advantages of the invention result from the following description of an exemplary embodiment and with reference to the drawing.

DETAILED DESCRIPTION OF THE PREFERRED EMBODIMENTS

Figure 1:
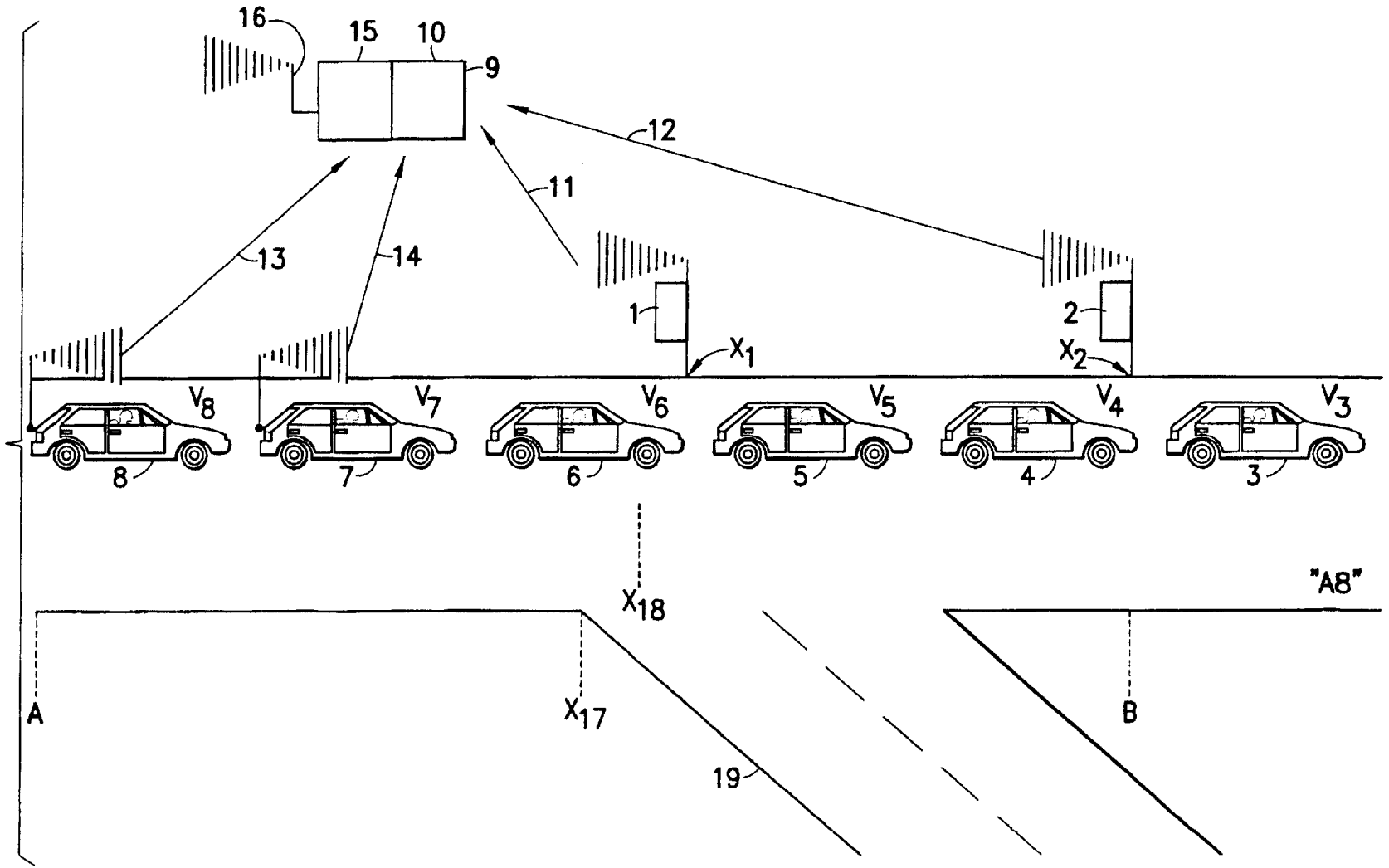
FIG. 1 shows, schematically, the determination according to the invention of traffic data in a traffic system (part of which is shown) using mobile and stationary detectors and a control center.

FIG. 1 shows an actual section of a traffic system, namely a section of a freeway "A8", with stationary detectors 1, 2 and vehicles 3 to 8. The center 9, which is also shown, has a receiver 10 for stationary detector data 11, 12 transmitted by the stationary detectors 1, 2 and for vehicle data (FCD) 13, 14 transmitted by mobile detectors in vehicles, a computer 15 with a program for further-processing incoming data according to the invention, and a connection for a transmitter 16 for transmitting traffic reports 17 to all of those in the traffic, or to specific receivers in the traffic. The transmitter 16 may be a mobile radio transmitter; it may also be a radio transmitter, in particular RDS/TMC or DAT.

The intention is to determine mean vehicle speeds at points of interest in a traffic system. These points of interest may be a large number of points on a specific grid system in the traffic system, or just specific points, such as specific highway segments, intersections, traffic jam hotspots etc.

Both stationary detector data measured by the stationary detectors 1; 2 at their fixed position $x_1$; $x_2$ and relating to the mean speed of all the vehicles 3; 3 to 6 passing (in this case driving on the left-hand side of the highway) this detector 1; 2 in each case in a time interval, as well as the mean speed of in each case one mobile detector in in each case one vehicle 7, 8 during a time interval, are intended to be taken into account by the center 9 when it calculates traffic data, in particular mean speeds at points of interest in a traffic system. The stationary detector 1 in FIG. 1 has measured the speeds $v_3$, $v_4$, $v_5$. The stationary detector 2 in FIG. 1 has measured the speed $v_3$ of the vehicle 3. The mobile detector in the vehicle 7 has determined the mean speed $v_7$ of the vehicle 7 during a time interval. The mobile detector 8 has determined the mean speed $v_8$ of the vehicle 8 during a time interval.

A problem in this case is that the data from the stationary detectors relate to the speed of a large number of vehicles at a specific point at different points in time, and the vehicle data (FCD) from mobile detectors relate to the speed of in each case one vehicle during a specific time interval.

The stationary detector data are averaged by the stationary detectors 1, 2 over time intervals which are in this case defined to be 30 seconds in each case for all the vehicles passing each sensor, and are transmitted to a the center. This transmission 11, 12 may be by fixed network or, as here, by radio, in particular mobile radio and in particular GSM. Vehicle data (FCD) from the mobile detectors in some of the vehicles, namely 7, 8, are transmitted by radio, in this case by mobile radio, to the center 9. In this case, the speeds of in each case one vehicle 7; 8 averaged over one time interval in each case are transmitted 13; 14 at time intervals of 10 minutes. Time intervals other than those described here may also be selected both for the stationary detectors and for the mobile detectors in vehicles; in this case, short time intervals give high prognosis accuracy, while long intervals reduce the communication costs.

The vehicle data and stationary detector data transmitted by the stationary detectors 1, 2 and the vehicles 7, 8 have gaps both in terms of position and time. For other interesting points in the traffic system, at which there are gaps in the available data, the existing vehicle data and stationary detector data can be used for interpolation. For this purpose, vehicle data which in each case relate to speeds of a vehicle within a time interval are initially associated, in the center 9, with points associated with this vehicle in the traffic system. This can be done particularly easily by in each case associating the vehicle data for a vehicle with at least one specific position on the road segments on which the vehicle is located; in particular, the vehicle speed can be associated with the start, middle or end of the current road segment for this vehicle. The errors which result in this case are not too serious. However, vehicle data for in each case one vehicle are in this way easily and efficiently associated with a specific position in the traffic system. The vehicle speeds at points of interest at which no vehicle data or stationary detector data are available can be calculated easily and efficiently by interpolation of vehicle speeds which are available as vehicle data and/or stationary detector data, in the spatial and/or time vicinity of this point of interest. In this case, the vehicle data and/or stationary detector data may be weighted; in particular, stationary detector data can be more heavily weighted. For a specific point in time, for example the current time, traffic data, in particular vehicle speeds, can be calculated at this point of interest. For this purpose, two items of vehicle data or stationary detector data which are, in particular, physically adjacent can be interpolated in different ways. Higher-order interpolation processes using curves or areas are possible. Linear interpolation requires less computation power, which provides particularly good results even in comparison with higher-level interpolation processes and, at the same time, requires only a low level of computation performance.

Figure 3:
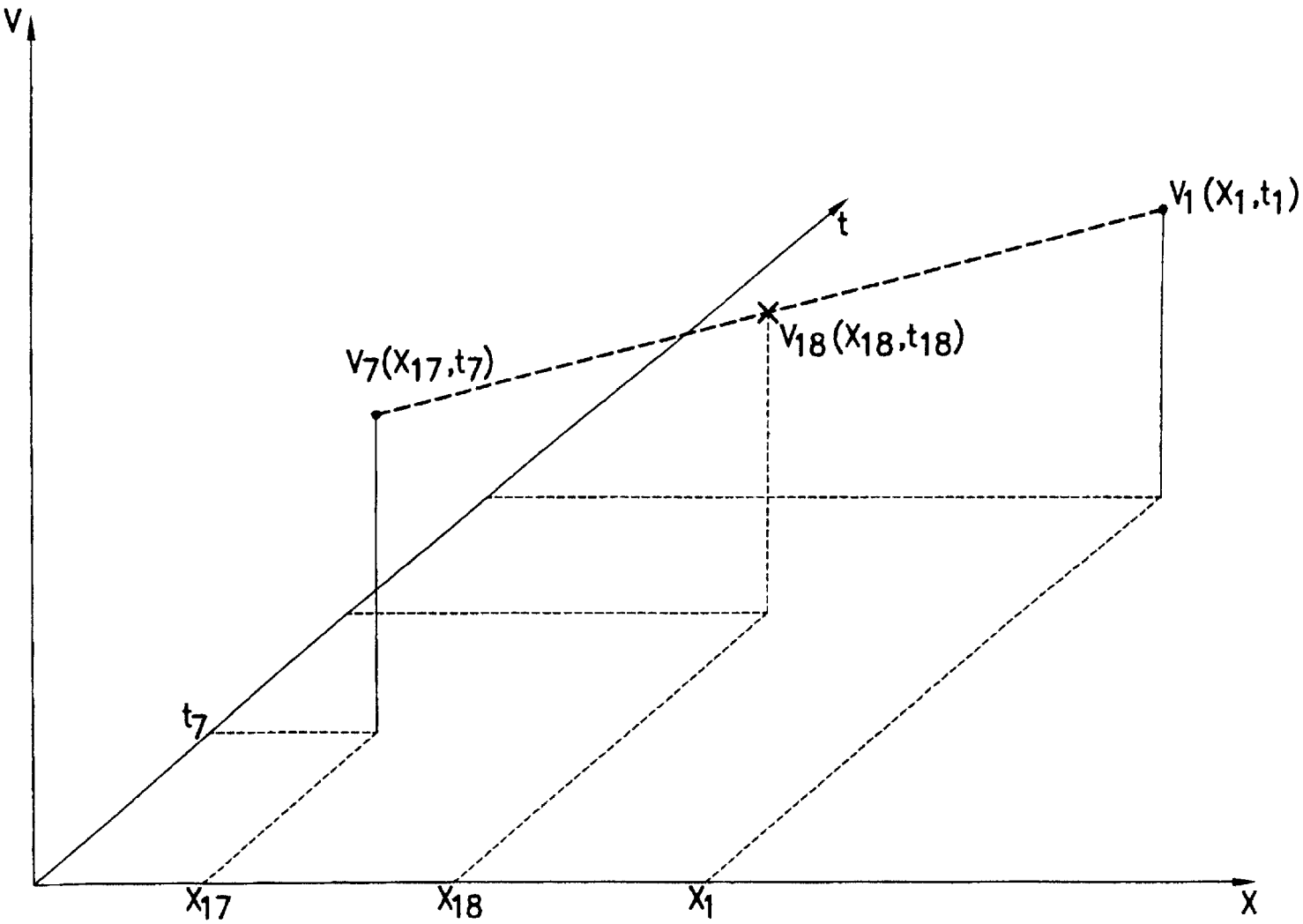
FIG. 3 shows, schematically, one example of space/time interpolation.

Linear interpolation will be explained using an example and with reference to the sketch in FIG. 3. The intention is to determine the mean speed of vehicles at the point in time $t_{18}$ at a point $x_{18}$ of interest. However, no vehicle data or stationary detector data are available at this point $x_{18}$ for the point in time $t_{18}$. The mean speed v of vehicles at this point $x_{18}$ of interest at the time $t_{18}$ is therefore determined from vehicle data and/or stationary detector data which are adjacent in terms of position and/or time by means of interpolation, in this case linear interpolation. The arrow x pointing to the right in FIG. 3 represents the location, the arrow t pointing upward and to the right represents the time, and the arrow v pointing vertically upward represents the mean vehicle speed. In the present case, the intention is to determine the mean vehicle speed at the point 18 of interest by interpolation of the vehicle speeds at two points between which the point of interest is located. If necessary, a different interpolation method may be used and/or the vehicle data and/or stationary detector data from more than two points may also be included.

In FIG. 3, the mean vehicle speed of the vehicle 7 within a specific time interval and the mean speed of vehicles passing the detector 1 within a time interval which is different in this case are taken into account without any weighting. In this case, the vehicle data which represents the mean speed $v_7$ of the vehicle 7 are initially assigned to the segment end 17 of the segment of the traffic system in which the vehicle 7 is located; such a segment end 17 may be located, for example, at a junction 19 of a road A8, at an intersection etc., or may be chosen arbitrarily by subdividing the road A8. The speed at a point of interest is in this case calculated by arithmetical averaging of the speeds $v_7$ and $v_1$, which may correspond to a straight line between these two points $v_7$ $(x_{17}, t_7)$ and $v_1$ $(x_1, t_1)$. If the point of interest is not located exactly between the two values $v_7$ and $v_1$, it is either possible to carry out arithmetic averaging despite this or to give a linearly greater weighting to the value which is physically closer. Furthermore, in principle, specific data items may be given greater weightings. For example, stationary detector data may be more heavily weighted than vehicle data.

The interpolation process can be carried out for a large number of points of interest in a traffic system. Points of interest may in this case be chosen using various criteria. For example, points which are each at a specific distance from one another may be chosen. Furthermore, it is also possible to choose specific points, such as traffic jam locations, junctions, intersections and/or road segment ends etc.

Traffic data v $(x_{18}, t_{18})$ etc. for a number of points of interest may be collated. For example, in FIG. 1, traffic data, in particular mean vehicle speeds, can be determined at a large number of points of interest along the freeway A8 in the traffic system. In this case, a reduced vehicle speed and/or increased fluctuation of vehicle speed at a number of points in time in the past may have been found, for example, between the points A and B in the traffic system. This indicates slow moving traffic, or even a traffic jam. The value "slow moving" may thus be assigned, for example, as a traffic jam indicator to the section between A and B of the freeway A8 in the traffic system. This may be transmitted from the traffic center 9 to one or more transmitters 16, and may be transmitted by this transmitter or transmitters via public channels and/or private channels, with or without being encrypted, as information for vehicle drivers.

The traffic information center 9 in this case comprises a receiver 10, for mobile telecommunication a transmitter as well, for incoming vehicle data and stationary detector data from mobile detectors 7, 8 and stationary detectors 1, 2. Furthermore, the center 9 comprises a computer with a program for carrying out the method according to the invention and which runs on this computer. Traffic data calculated using this program, in particular mean speeds at points of interest and/or traffic jam indicators at these points of interest or at some of the points of interest, are transmitted to at least one transmitter 16.

Figure 2:
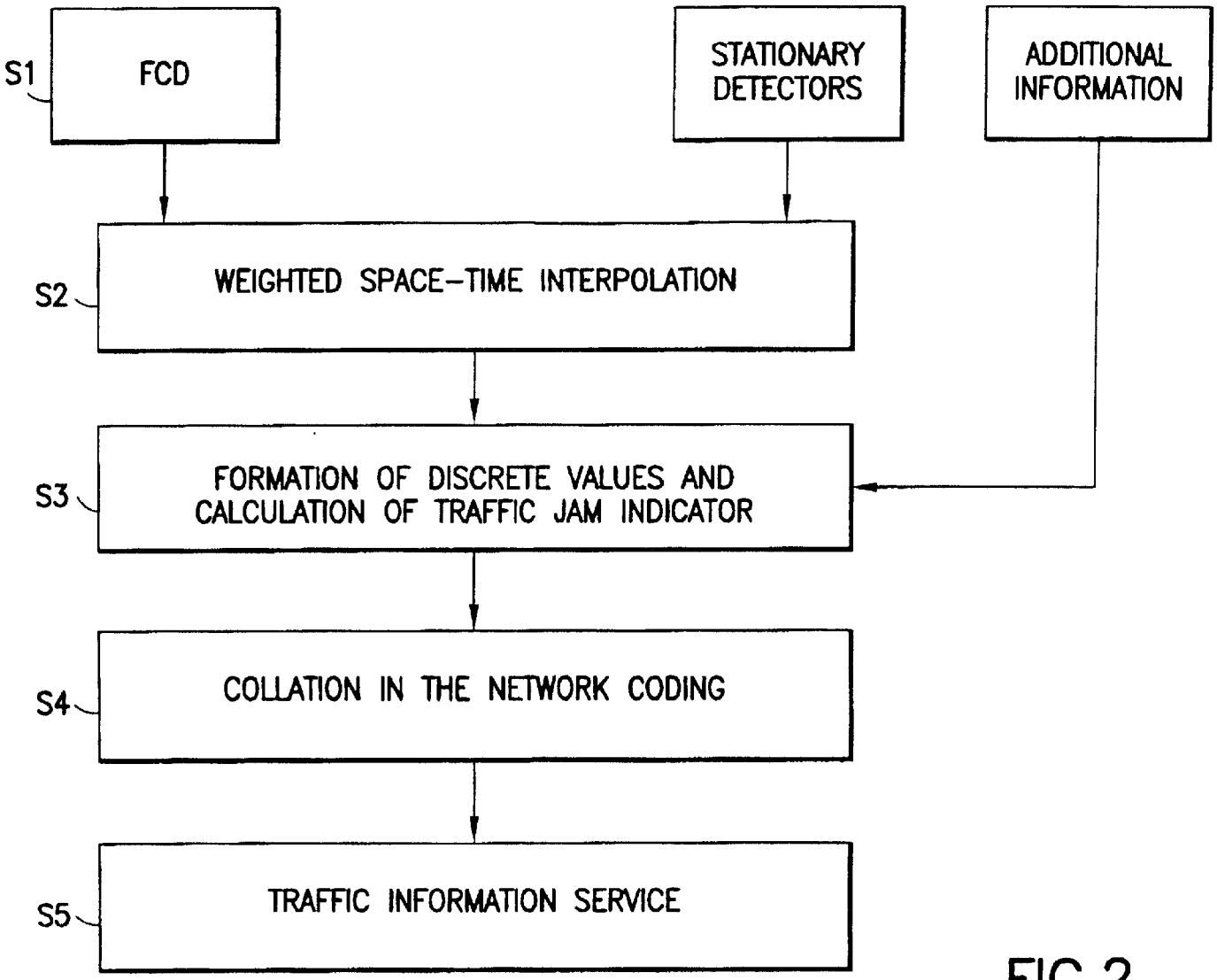
FIG. 2 shows an outline flowchart of the gathering and further processing of vehicle data and stationary detector data.

The method, which is implemented as a program in the center 9, is roughly outlined in FIG. 2. In the first step S1, vehicle data (FCD) from mobile detectors in vehicles and stationary detector data from stationary detectors, for example loops, are gathered and are transmitted to the center 9. In the step S2, the vehicle data and stationary detector data are interpolated in the center 9, with space/time weightings, for points of interest. In step S3, such traffic data obtained by interpolation, in particular mean vehicle speeds at points of interest, is converted to discrete values and traffic jam indicators (for example "free", "slow moving", "very slow moving", "traffic jam") are assigned to a point, or to a group of points of interest. In this step (S3) additional information, such as the proportion of trucks in specific traffic lanes, roadworks and, inter alia, data based on experience are also taken into account. In the step S4, traffic data, in particular traffic jam indicators for specific points in the traffic system, are collated for the network. Furthermore, they are in this case coded, so that only certain recipients in the traffic can evaluate them after reception. In the step S5, traffic data, in particular traffic jam indicators, are transmitted by a traffic information service to vehicles etc. By way of example, radio transmitters may be used for transmission. Furthermore, encrypted transmission via radio transmitters is also possible. The keys may in this case be transferred to recipients in the traffic in various ways.

FIG. 2 captions:

1 Stationary detectors
2 Additional information
3 Weighted space-time interpolation
4 Formation of discrete values and calculation of traffic jam indicator
5 Collation in the network, coding
6 Traffic information service

What is claimed is:

1. A method for determining traffic data at points of interest in a traffic system, comprising the steps of:

transmitting vehicle data to a center from a plurality of vehicles, relating to mean speeds which have been determined over a time interval of in each case one vehicle;

transmitting stationary detector data to the center by stationary detectors in each case relating to mean speed of vehicles passing a stationary detector in a time interval;

determining vehicle speeds at a point of interest and for a specific point in time at the center;

associating the speeds which have been transmitted as vehicle data to the center with defined points in the traffic system; and calculating vehicle speeds at in each case one point of interest by interpolation of at least two vehicle data items, including interpolating at least one of stationary detector data measured in each case at at least one point in the traffic system and vehicle data associated with at least one point in the traffic system.

2. A method as defined in claim 1, wherein the step of calculating speeds at points of interest includes weighting the at least one of the vehicle data and the stationary detector data.

3. A method as defined in claim 1, including determining the speed at a point in time at a point of interest by linear interpolation of two speed values which are adjacent in terms of at least one of position and time.

4. A method as defined in claim 1, wherein additional information is included in the interpolation.

5. A method as defined in claim 1, including associating vehicle data by definition of the speed which in each case represents one vehicle in the vehicle data as the speed at a specific position in a road segment at which the vehicle is currently located.

6. A method as defined in claim 1, further including associating a traffic jam indicator with points of interest in the traffic system based on the calculated vehicle speeds and measured vehicle speeds.

7. A method as defined in claim 6, further including determining and issuing traffic information relating to traffic system segments based on a plurality of traffic jam indicators which are associated in terms of position with these traffic system segments.

8. A method as defined in claim 1, including transmitting at least one of the vehicle data and the stationary detector data to the center by radio.

9. A method as defined in claim 1, wherein the vehicle data relates to speeds which have been averaged over a longer time interval than the stationary detector data.

10. A method as defined in claim 1, including averaging the vehicle data over a time interval of 10 minutes for the respective vehicle.

11. A method as defined in claim 1, including determining stationary detector data over a time interval of 30 seconds, averaging the determined stationary detector data and then transmitting the data after the time interval.

12. A traffic information center, comprising:

a computer;

an input apparatus for vehicle data and stationary detector data; and a program for carrying out a method for determining traffic data at points of interest in a traffic system by transmitting vehicle data to a center from a plurality of vehicles, relating to mean speeds which have been determined over a time interval of in each case one vehicle; transmitting stationary detector data to the center by stationary detectors in each case relating to mean speed of vehicles passing a stationary detector in a time interval; determining vehicle speeds at a point of interest and for a specific point in time at the center; associating the speeds which have been transmitted as vehicle data to the center with defined points in the traffic system; and calculating vehicle speeds at in each case one point of interest by interpolation of at least two vehicle data items, including interpolating at least one of stationary detector data measured in each case at at least one point in the traffic system and vehicle data associated with at least one point in the traffic system.

* * * * *

UNITED STATES PATENT AND TRADEMARK OFFICE

CERTIFICATE OF CORRECTION

PATENT NO. : 6,329,932 B1
DATED : December 11, 2001
INVENTOR(S) : Ulrich Fastenrath It is certified that error appears in the above-identified patent and that said Letters Patent is hereby corrected as shown below:

Title page,
Item [75], please correct inventors name as follows:
-- [75] Ulrich Fastenrath, Düsseldorf (DE) --

Signed and Sealed this

Twenty-eighth Day of May, 2002

*Attest:*

*Attesting Officer*

JAMES E. ROGAN
*Director of the United States Patent and Trademark Office*